US009277804B1

(12) United States Patent
Gennodie

(10) Patent No.: US 9,277,804 B1
(45) Date of Patent: Mar. 8, 2016

(54) HANDHELD CARRIER FOR CELLPHONE AND ACCESORIES

(71) Applicant: Benedita Gennodie, Suffern, NY (US)

(72) Inventor: Benedita Gennodie, Suffern, NY (US)

( * ) Notice: Subject to any disclaimer, the term of this patent is extended or adjusted under 35 U.S.C. 154(b) by 0 days.

(21) Appl. No.: 14/593,374

(22) Filed: Jan. 9, 2015

(51) Int. Cl.

| | |
|---|---|
| ***A45C 1/06*** | (2006.01) |
| ***A45F 5/10*** | (2006.01) |
| ***A45C 1/02*** | (2006.01) |
| ***A45C 1/08*** | (2006.01) |
| *A45F 5/00* | (2006.01) |

(52) U.S. Cl.
CPC ... *A45F 5/10* (2013.01); *A45C 1/02* (2013.01); *A45C 1/06* (2013.01); *A45C 1/08* (2013.01); *A45F 2005/002* (2013.01); *A45F 2005/1086* (2013.01)

(58) Field of Classification Search
CPC ..... A45F 5/10; A45C 1/02; A45C 1/06; A45C 1/08
See application file for complete search history.

(56) References Cited

U.S. PATENT DOCUMENTS

| | | | | | |
|---|---|---|---|---|---|
| 4,126,168 | A * | 11/1978 | Ganz | A45C 1/08 | 150/136 |
| 4,287,971 | A * | 9/1981 | Doulet | A45C 3/00 | 150/117 |
| 4,424,841 | A * | 1/1984 | Smith | A45C 7/0086 | 190/102 |
| 4,502,596 | A * | 3/1985 | Saetre | B65D 75/42 | 206/466 |
| 4,509,667 | A | 4/1985 | Meldrum | | |
| 4,545,414 | A * | 10/1985 | Baum | A45C 1/04 | 150/107 |
| 4,570,688 | A * | 2/1986 | Williams | A45C 1/04 | 150/102 |
| 4,998,653 | A * | 3/1991 | LaBelle | A45F 5/00 | 224/240 |
| D323,428 | S * | 1/1992 | Wang | D3/252 | |
| D338,340 | S * | 8/1993 | Burks | D3/230 | |
| 5,285,833 | A * | 2/1994 | Haxby | A45C 1/04 | 150/102 |
| 5,450,991 | A * | 9/1995 | Neading | A45F 3/00 | 224/250 |
| D371,675 | S | 7/1996 | Carter | | |
| D373,900 | S | 9/1996 | Montgomery | | |
| D379,262 | S | 5/1997 | Seigel | | |
| 5,806,730 | A * | 9/1998 | Deno | A45F 5/02 | 224/148.6 |
| 6,047,064 | A | 4/2000 | Lyons | | |
| 6,182,878 | B1 * | 2/2001 | Racca | A45C 15/00 | 224/236 |
| 6,330,961 | B1 | 12/2001 | Borja | | |
| 6,443,341 | B1 | 9/2002 | Rittmann | | |
| D501,990 | S | 2/2005 | Carr | | |
| D554,365 | S | 11/2007 | Zhou | | |
| D616,197 | S | 5/2010 | Fuccella | | |
| D654,265 | S | 2/2012 | Roy | | |
| D691,367 | S | 10/2013 | Chappell | | |
| D700,774 | S | 3/2014 | Morgan et al. | | |

(Continued)

FOREIGN PATENT DOCUMENTS

GB 2209928 A 6/1989

*Primary Examiner* — Brian D Nash
(74) *Attorney, Agent, or Firm* — Michael E. Zall

(57) ABSTRACT

A handheld carrier for a cellphone and accessories with a cellphone holder that permits the front face of the cellphone to be exposed for use and the rear covered by a rear wall. First and second accessory holders are provided, each having an inner and outer wall forming an interior enclosure for holding accessories. The inner wall of the first accessory holder is mounted to the rear wall of the cellphone holder and the inner wall of the second accessory holder is mounted to the outer wall of the first accessory holder. Optionally, these are removable mountings, e.g., hook/loop, providing for interchangeability of holders. A hand strap with first and second ends is provided, the first end is preferably removably mounted to a side of the cellphone holder or an accessory holder, the second end is removably mounted to an opposed side of the same cellphone holder or accessory holder.

16 Claims, 6 Drawing Sheets

(56) References Cited

U.S. PATENT DOCUMENTS

2005/0145657 A1 7/2005 Norberg
2006/0059628 A1* 3/2006 Hamilton ..... A47C 4/52 5/653
2006/0176660 A1* 8/2006 Amiri ..... G06F 1/1615 361/679.09
2008/0017678 A1 1/2008 Anderson et al.
2009/0057357 A1* 3/2009 Rohrbach ..... A45F 5/00 224/222
2009/0199939 A1 8/2009 Pruzhansky
2012/0104059 A1* 5/2012 Yen ..... A45C 11/00 224/218
2013/0270129 A1* 10/2013 Johnson ..... A45C 11/38 206/216

* cited by examiner

HANDHELD CARRIER FOR CELLPHONE AND ACCESORIES

FIELD OF THE INVENTION

This invention relates to a hand held cellular phone ("cellphone") and accessory carrier that includes a cellphone holder for firmly holding the cellphone and permitting quick access to the front face of the cellphone, and, for example, a wallet and a purse for carrying accessories, e.g., personal items and identification cards, and a hand strap. Various elements are removable and interchangeable to provide varying functionalities and fashion configurations.

BACKGROUND OF THE INVENTION

Various means have been suggested over the years for allowing a user to carry accessories while exercising, e.g., running, walking, going to the gym. When accessories, such as change, keys, cellphones, identification cards, credit cards, identification cards or wallets, etc., are placed in the users pockets while exercising they may fall out, are bulky and make it cumbersome to exercise. Several type devices have been developed for holding such accessories while exercising, e.g., a wrist mounted wallet, forearm mounted pouches, armband devices, ankle strap devices, etc.

However, in today's world substantially everyone has a cellphone that they take everywhere, along with their identification cards and other accessories, such as keys and cosmetics and make-up. The type devices used during exercising are inappropriate in many circumstances and environments in that they are firmly mounted on the arm, wrist, or leg and are difficult to put on and take off at a moment's notice, and are inappropriate at social events or business meetings. Although, large handbags can be used, they are generally bulky to carry around, not suitable for men and do not allow quick access to a cellphone.

There is thus a need for a carrier for cellphones and accessories that can be easily and securely carried during physical activities, is attractive to use at social events and business meetings, provides quick access to the user's cell phone and accessories and can be easily adapted to carrying various different accessory articles.

The following references may be relevant to this invention:

US Published Application 2005/0145657 to Norberg discloses an accessory pack worn on the arm that has a plurality of compartments, e.g., a cell phone pocket closed off by a flap and another pocket that can hold keys, a driver's license, etc.

US Published Application 2008/0017678 to Anderson discloses a wrist pouch for electronic equipment having a compartment for holding an electronic device (PDA), along with a backing panel to hold the device in place, and an adjustable strap. A cover panel is included that can be moved from a closed position covering and protecting the display screen to an open position exposing the display screen for viewing during use.

US Published Application 2009/0199939 to Pruzhansky discloses a purse system for holding personal items on a person's wrist through a wrist band secured to the wrist.

In U.S. Pat. No. 4,509,667 to Meldrum discloses a camera support for mounting on the arm of a user for carrying and positioning a camera for use during periods of physical activity such as skiing, surfing and the like.

U.S. Pat. No. 6,047,064 to Lyons discloses a hands free phone system that includes an arm-mounted housing for maintaining the phone unit on a user, a head set that includes a an earphone and a microphone coupled to the phone unit for communicating audio signals.

U.S. Pat. No. 6,330,961 to Borja discloses a pouch having various storage pockets for the storage of personal articles mounted upon a forearm of a user. A personnel communicator device is positioned in the pouch. The device has a data transmission portion, a keyboard and a character display screen, facing the driver of the vehicle for facilitating data exchange between the driver and the personnel communicator device while operating the vehicle.

U.S. Pat. No. 6,443,341 to Rittmann discloses a wrist wallet made of mesh fabric having several pockets. All pockets have a single laterally elongated sealing element at the top of the wallet in the form of a zipper. The wallet has an attaching means that is hooks and eyes that secures the wallet about a wearer's wrist.

GB2209928A to Hsien-Ming discloses a waterproof wrist purse made of a flexible plastic material. The opening of the purse is releasably closed by interengaging ribbed and grooved strips which can be tightly snapped to render the purse waterproof. During swimming, the purse is attached to the wrist by a band, which may be elastic or have two free ends joined by press-studs, buckle, or hook and loop type fasteners Some US Design patents that may be relevant to this invention are:

D371675 to Carter
D373900 to Montgomery, Sr.
D379262 to Seigel
D501990 to Carr
D554365 to Zhou
D616197 to Fuccella
D654265 to Roy
D691367 to Chappell
D700774 to Morgan

OBJECTS AND SUMMARY OF THE INVENTION

In view of the foregoing inherent functions in the known accessory carriers, it is an object of the present invention to provide a fashionable handheld carrier for a cellphone and accessories suitable for use at social events and business meetings that provides quick access to the user's cellphone and the accessories held therein and can be easily slipped on and off the hand.

It is a further object of this invention to provide a handheld carrier for a cellphone and accessories that can be converted to several configurations depending on the accessories to be held and the user's preference.

It is yet another object of this invention is to provide a handheld carrier for a cellphone and accessories that has a hand strap and accessory holders wherein the look and function of the accessory carrier may be changed by interchanging the hand strap and/or accessory holders.

Broadly, this invention is directed to carrier for a cellphone and accessories adapted to be held in a hand of the user. The carrier includes a cellphone holder for holding a cellphone. The typical cellphone has a rear face and a front face, wherein the front face is used for initiating and carrying out functionalities of the cellphone. The cellphone holder includes sidewalls that form an enclosure for the cellphone wherein the front face of the cellphone is exposed for use by the user. The rear face is covered by a rear wall having an inside surface overlaying the rear face of the cellphone and an outside surface. The carrier further includes a first and second accessory holder, each having an inner wall and an outer wall forming an interior enclosure for securely holding accessories, such as keys, identification cards, money, etc. Each of the walls of the accessory holders has an exterior surface. The carrier further has the exterior surface of the inner wall of the first accessory holder mounted to the outside surface of the rear wall of the cellphone holder and the exterior surface of the inner wall of the second accessory holder mounted to the exterior surface of outer wall of the first accessory holder. Optionally, the mountings to the outside surfaces may be removable mountings, e.g., hook and loop type mountings, adhesives, etc.

A hand strap is provided that has a first end and a second end, wherein the first end is mounted to a side of one of the cellphone holder or accessory holders and the second end is mounted to an opposed side of the same cellphone holder or accessory holder. Preferably such mountings are removable with, for example, interlocking clips or snaps. The hand strap is of a length that permits the carrier to be easily slipped on and off the hand.

More specifically, the accessory holders in a preferred embodiment are:

b. A wallet having an inner flap and an outer flap foldably connected to each other to form an interior enclosure for holding identification cards, each flap having an exterior surface; and c. A purse having a front section and a rear section, each section being fixed together at a common edge, the sections define an outside surface and an interior enclosure for carrying accessories, a purse closure for closing the interior enclosure to secure the accessories therein.

The carrier wallet and purse are interchangeable in their positioning with respect to the cellphone holder. More specifically, i. the exterior surface of the inner flap of the wallet may be mounted to the outside surface of the rear wall of the cellphone holder and the outside surface of the front section of purse may be mounted to the exterior surface of the outer flap of the wallet; or ii. the outside surface of the front section of purse may be mounted the outside surface of the rear wall of the cellphone holder and the exterior surface of the inner flap of the wallet may be mounted to the exterior surface of the rear section of the purse.

The carrier is further provided with a hand strap having a first end and a second end, wherein the first end is mounted to a side of one of the cellphone holder, wallet or purse and the second end is mounted to an opposed side of the same cellphone holder, wallet or purse. The hand strap is of a length that permits the carrier to be easily slipped on and off the hand.

The present invention provides a versatile hand held carrier that allows the user to securely carry a purse and/or wallet along with a cellphone in their hand, provides rapid access to the cellphone display screen and contents in the wallet and/or purse and permits the user to selectively adapt the carrier to the needs of the user and the social or business environment by providing a selection of hand straps and various configurations of the cellphone holder, purse and wallet. Other features and advantages of the present invention will become apparent from the following more detailed description, taken in conjunction with the accompanying drawings, which illustrate, by way of example, the principles of the invention.

BRIEF DESCRIPTION OF THE DRAWINGS

Further aspects, features and advantages of the present invention will become even more apparent with reference to the following detailed description and the accompanying drawings.

The drawings are not presented to scale but are only used to illustrate the principles of the invention. In the drawings, like reference numbers indicate like elements.

DETAILED DESCRIPTION OF THE INVENTION

Figure 1:
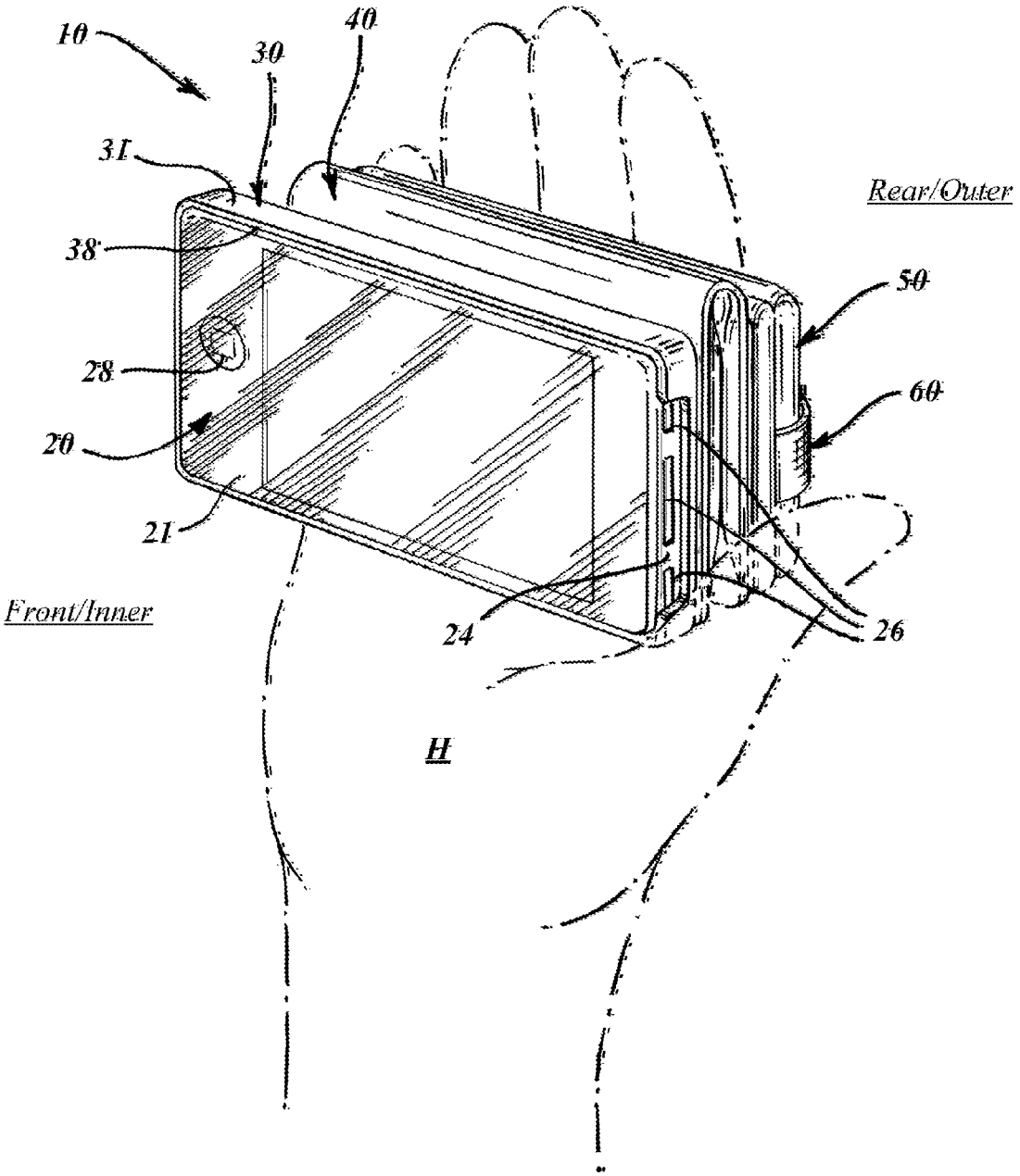
FIG. 1 is a perspective view of an embodiment of the handheld carrier for a cellphone and accessories of this invention as seen from one direction being held by the user.

A detailed description of one or more embodiments is provided below along with accompanying figures that illustrate the principles of the embodiments. The scope of the embodiments is limited only by the claims and encompasses numerous alternatives, modifications and equivalents. Numerous specific details are set forth in the following description. These details are provided solely for the purposes of example and the embodiments may be practiced according to the claims without some or all of these specific details.

Referring now to the drawings, in which like numerals represent like elements throughout the several views. FIGS. 1-7 depict embodiments of the cellphone and accessory carrier 10 according to the present invention.

As used herein, for brevity, a "cellular phone" will be referred to herein as a cellphone 20, and includes any wireless or cordless phone, typically a "smart phone" such as an Android®, Samsung®, Blackberry® or IPhone® brand phone, although this invention is not so limited.

Such cellphones 20 have numerous functions and are used with a wide range of applications, e.g., phone calls, Skype® calls, internet searching, Facebook®, Instagram®, voice recording, etc. A typical cellphone 20 includes a front face 21 that includes display screen 22, typically a touchscreen, and optionally, for example in the Blackberry® brand cellphone 20, function and input keys (not shown) for the user to input and output messages and data. The display screen 22 is used for initiating and carrying out the functionalities of the cellphone 20. Conventional cellphones 20 are generally rectangular, but they can be any number of shapes including, but not limited to, circular, elliptical, polygonal, etc. The cellphone 20 also includes a back or rear face 23. Optionally, the sides 24 of the cellphone 20 may have other functionalities, e.g., on/off switches, volume control, earphone jacks, charging port, data transfer port (USB port), etc.

Figure 3:
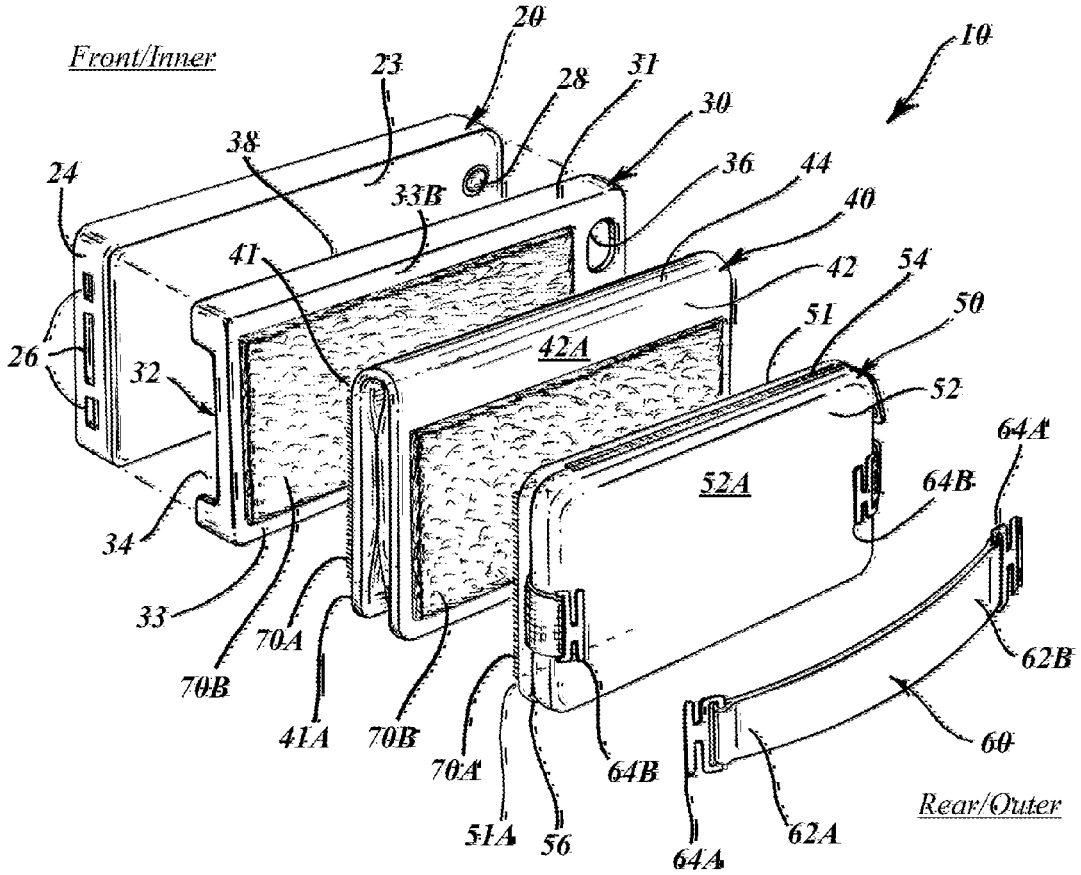
FIG. 3 is an exploded perspective view showing an embodiment of the handheld carrier for a cellphone and accessories of this invention showing the components of the invention.

Referring for example to FIG. 3, the handheld carrier for a cellphone and accessories 10 of this invention includes a cellphone holder 30 for holding the cellphone 20. Broadly, the cellphone holder 30 includes sidewalls 31 that form an enclosure or cavity 32 that permits the display screen 22 in the front face 21 of the cellphone to be exposed for use by the user. The sidewalls 31 are sized and shaped to form an enclosure or cavity 32 for receiving the cellphone 20. Although not shown in the Figures, the cellphone holder 30 may have a cover thereon to protect the front face 21 and display screen 22. Ideally, such a cover can be easily removed to quickly expose the display screen 22 for use.

Figure 5:
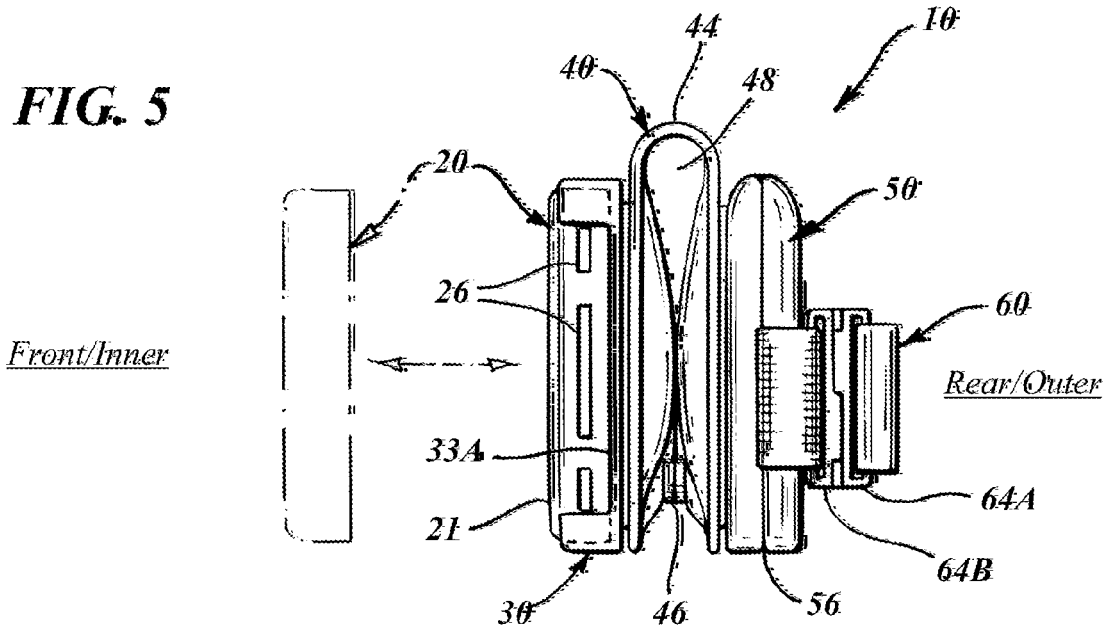
FIG. 5 is a side view taken along view-line 5-5 of FIG. 2.

Referring to FIGS. 3 and 5, the rear face 23 of the cellphone 20 is covered by a rear wall 33 having an inside surface 33A overlaying the rear face 23 of the cellphone 20. This rear wall 33 may be made of plastic, leather or any other sheet material. The rear wall 33 also has an outside surface 33B.

Figure 2:
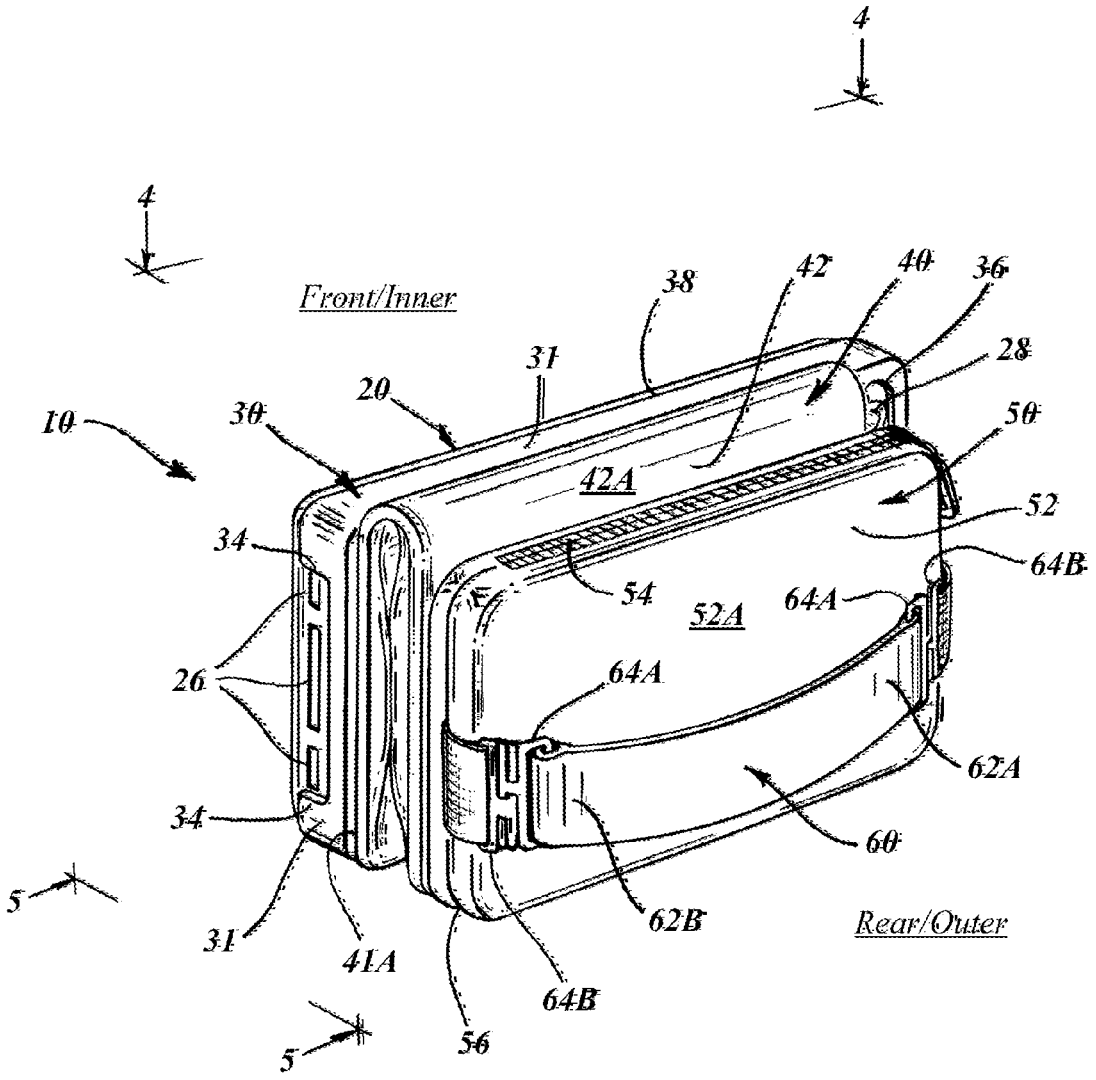
FIG. 2 is a perspective view of the cellphone and accessory carrier as seen from the opposite side of FIG. 1.
Figure 6:
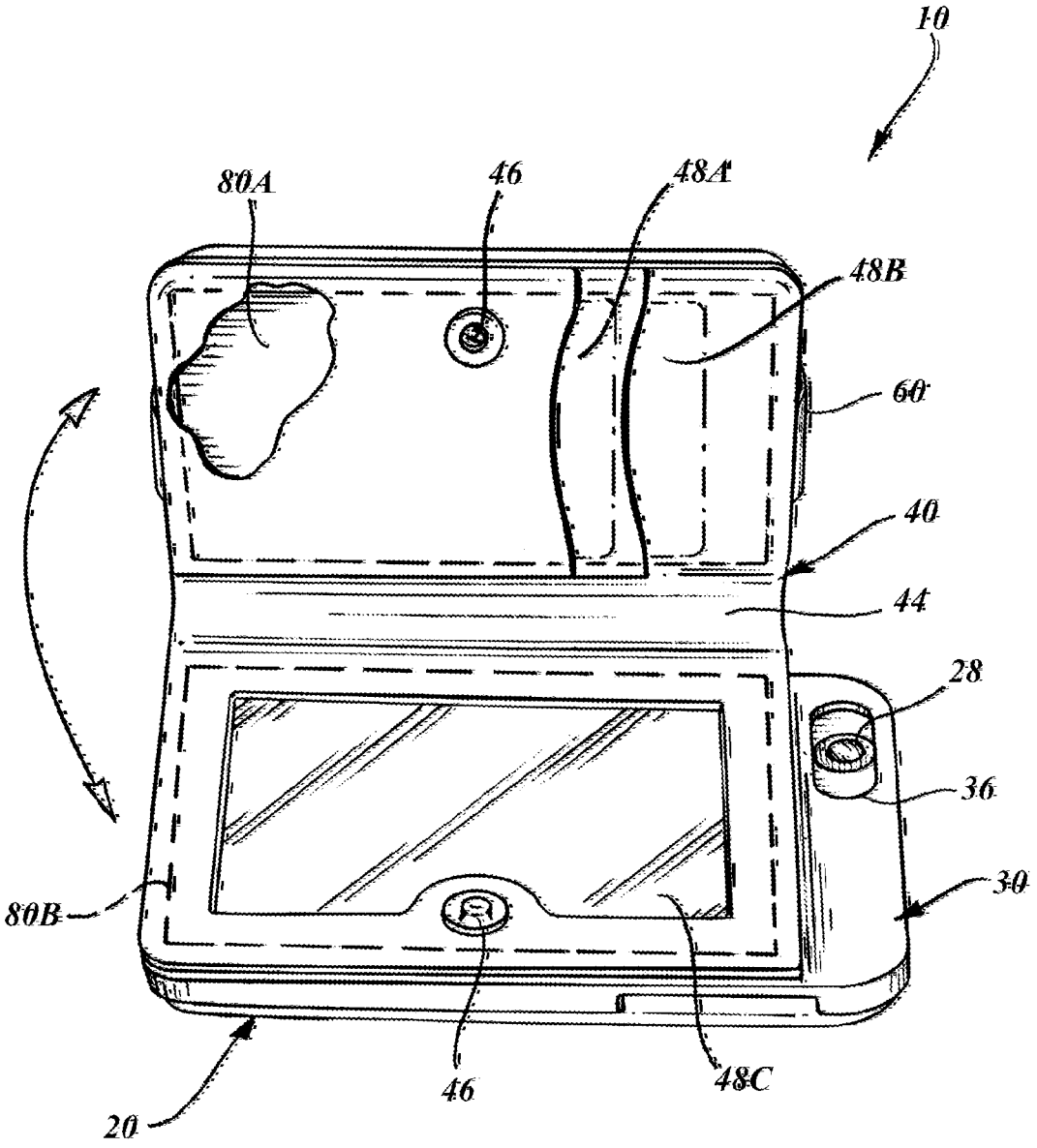
FIG. 6 is a perspective view wherein the wallet accessory holder is opened for access.
Figure 7:
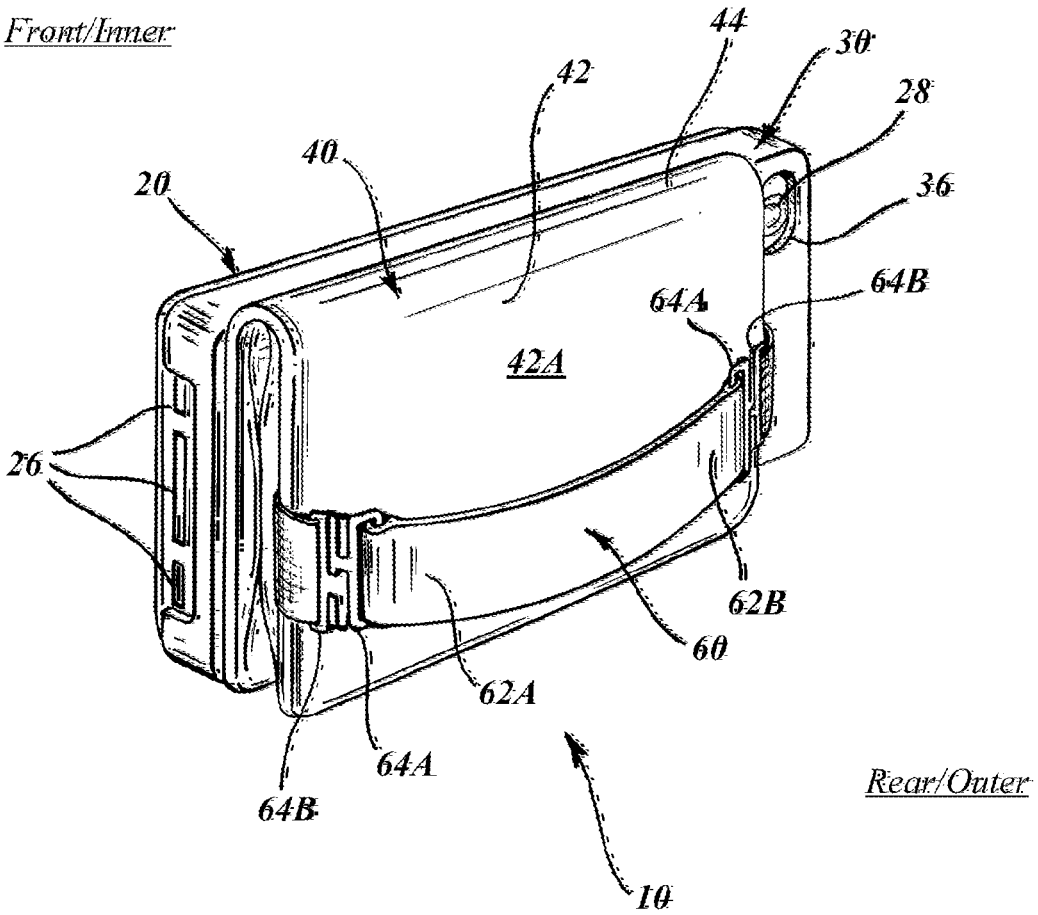
FIG. 7 is a perspective view showing an alternative embodiment wherein the carrier is a cellphone holder and wallet.

Referring for example to FIG. 3, the cellphone holder 30 may have auxiliary openings 34 that align with connection ports 26 on the cellphone for connecting auxiliary components (earphones, charger, etc.) to the cellphone 20 when it is in the cellphone holder 30. Referring to FIGS. 2, 3 and 6, the cellphone holder 30 may also be provided with a camera opening 36 for the camera lens 28. The cellphone holder 30 depicted herein has sidewalls 31 that have edges 38 that snap over the front face 21 of the cellphone 20 to hold it securely in the cellphone holder 30. Typically, the cellphone holder 30 is rectangular and slightly larger than the cellphone 20.

The cellphone holder 30 depicted herein is only an example of the type holder that can be used. There are numerous other type cellphone holders 30 that may be used. The cellphone holder 30 can be made from a variety of materials. In the embodiment depicted herein, the cellphone holder 30 is made from a hard plastic. Other materials for the cellphone holder 30 include leather, a durable fabric, a flexible polymer, rubber, graphite, fiberglass, or combinations thereof. As stated, the cellphone holder 30 may have a removable face cover to protect the display screen 22.

Broadly, the cellphone and accessory carrier 10 includes a first accessory holder 40, e.g., a wallet 40, and a second accessory holder 50, e.g. a purse 50, each having an inner wall 41, 51 and an outer wall 42, 52 forming an interior enclosure for securely holding accessories, see for example FIG. 6, wallet 40 and enclosure 48, the enclosure in the purse 50 not being shown. Each of the walls 41, 42, 51, 52 has an exterior surface 41A, 42A, 51A, 52A, respectively. The exterior surface 41A of the inner wall 41 of the first accessory holder 40 is mounted to the outside surface 33B of the rear wall 33 of the cellphone holder 30. Additionally, the exterior surface 51A of the inner wall 51 of the second accessory holder 50 is mounted to the exterior surface 42A of outer wall 42 of the first accessory holder 40.

In one preferred embodiment depicted in the Figures, the first accessory holder 40 is a wallet 40 that is mounted to the cellphone holder 30 and the second accessory holder 50 is a purse 50 that is mounted to the wallet 40. It should be understood this may be reversed with respect to their positions. Additionally, this invention is not to be limited to the accessory holders purse 50 and wallet 40 depicted herein. There are numerous other accessory holders that may be used, e.g., cosmetic cases, change purses, key holder cases, money clip case, business card holders, pill holders, etc. The Figures depict only two type accessory holders, i.e., a purse 50 and a wallet 40, however more than two accessory holders may be utilized and, optionally only one may be used. For example, in FIG. 7 only one accessory holder 40 is depicted showing a wallet 40 mounted to the cellphone holder 30. This permits the manufacturer or user to custom design and configure the carrier 10 for use by men and/or women and/or fulfill various utilitarian needs of the user.

The wallet 40, in its common and well known form, has a front section or inner wall 41 and a rear section or outer wall 42 each section or wall being pivotally fixed together at a common edge or fold line 44; see for example FIGS. 5 and 6. Together the sections or wall 41, 42 define an exterior surface 41A, 42A and an interior enclosure 48. The wallet 40 may be made from any suitable materials, such as leather, fabric, vinyl, plastic, animal skin, or the like, utilizing conventional purse construction methods.

Referring to FIG. 6, the wallet 40 used in the cellphone and accessory carrier 10 of this invention may have a plurality of pockets or compartments, 48A, 48B and 48C for accommodating various accessories for use, e.g., identification cards, tissues, money in the enclosure 48.

As used herein, the use of the term "identification cards" should be considered in its broadest sense to include flat, card like or sheet like elements, which may be foldable, such as credit cards, drivers licenses, insurance cards, value cards, passports, and other type identification sheets typically found in wallets. The wallet 40 may be sealed off by mating snaps 46 to prevent the accessories, e.g., identification cards, contained therein from dropping out or from being taken by others. Other type closure systems may be used, e.g., closure flaps, magnetic snaps, Velcro® brand closures (hook and loop), string closures, etc.

Referring to FIG. 6, Optionally, the accessory holder, in particular the wallet 40 may include a shield 80A and 80B that is an RFID-blocking device that makes it more difficult for someone with an electronic reader to read contactless credit or debit cards, i.e., cards or key fobs with RFID chips in them, to prevent the theft of such cards or key fobs. The shield 80A, 80B may be built into the wallet 40 or added as a card on both sides of the identification cards therein. RFID blocking cards that are wallet sized are presently commercially available.

Referring to the Figures, the purse 50 used in the handheld carrier for a cellphone and accessories 10 of this invention may have a plurality of pockets or compartments (not shown) for accommodating various accessories for use, e.g., keys, change, identification cards, cosmetics, tissues. Preferably, the carrier 10 for security purposes has the purse 50 located near the user's hand with the enclosure sealed off with a zipper 54 to prevent the accessories contained therein from dropping out or from being taken by others. Other type closure systems may be used for the purse 50, e.g., closure flaps, mating snaps, magnetic snaps, Velcro® brand closures (hook and loop), string closures, etc.

Figure 4:
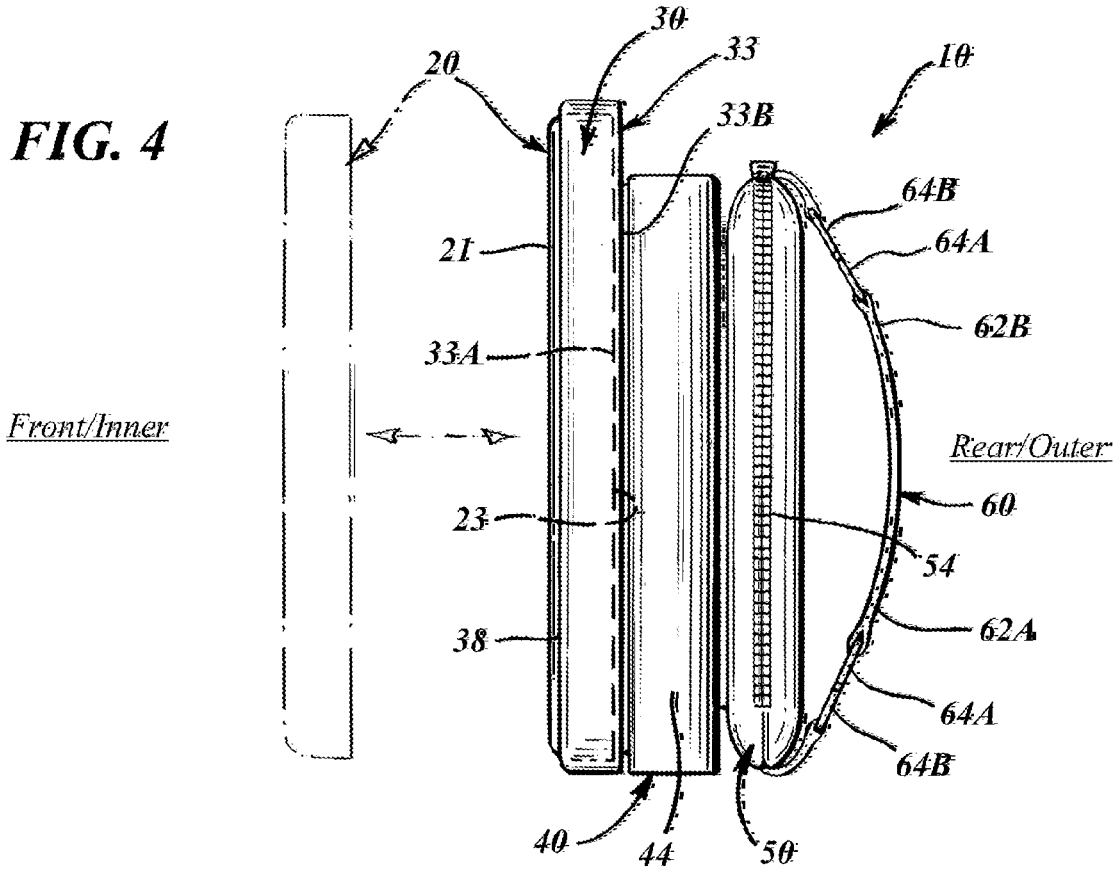
FIG. 4 is a top plan view taken along view-line 4-4 of FIG. 2.

The purse 50, in its common and well known form, has an inner section or wall 51 and an outer section or wall 52, each section being pivotally fixed together at a common lower edge 56; see FIG. 4 for example. The purse 50 further includes a purse closure, such as a zipper 54, for sealing the inside surface of the purse 50 within an enclosed space. Together the sections 51, 52 define an outside surface 51A, 52A and an interior (not shown). The purse 50 may be made from any suitable materials, such as leather, fabric, vinyl, plastic, animal skin, or the like, utilizing conventional purse construction methods.

As used herein the term "front" or "inner" wall or section refers to the direction facing the cellphone holder 30 and cellphone 20 or to the left in FIGS. 1-5 and 7. Likewise, as used herein the term "rear" or "outer" wall or section refers to the direction facing away from the cellphone holder 30 and cellphone 20 or to the right in FIGS. 1-5 and 7. This is clearly labeled in the Figures.

Referring for example to FIGS. 2 and 3, a hand strap 60 is provided that has a first end 62A and a second end 62B. The first end 62A is mounted to a side of one of the elements, i.e., 30, 40, 50. More specifically the first end 62A may be mounted to cellphone holder 30, the first accessory holder 40, or the second accessory holders 50. The second end 62B is mounted to an opposed side of the same cellphone holder 30, the first accessory holder 40, or the second accessory holders 50. Preferably the hand strap 60 is removably mounted through interlocking clips 64A and 64B to the cellphone holder 30, the first accessory holder 40, or the second accessory holders 50.

In the embodiment depicted in the Figures the hand strap 60 is attached to the sides of the purse 50, preferably removably attached thereto through mating clips 64A and 64B at each end of the hand strap 60.

The hand strap 60 is of a length and flexibility to permit the hand strap 60 to easily pass over the user's hand H when in use, see FIG. 1, and snugly fit thereon when the hand H is in an open position so that the carrier 10 does not fall from the hand and yet can be easily slipped off for access to the accessory holders, 40, 50 and cellphone 20. The clips 64A, 64B do not have to be unclipped to place the carrier 10 on or off the hand H. The carrier 10 may be selectively fixed to the hand H permitting the user to carry the carrier 10 securely with the hand H and having rapid access to the cellphone 20 display screens 22 for reading or use. The hand strap 60 is removably secured in place and is preferably made of a soft cushioning material such as neoprene or a flexible, stretchable strip that is decoratively or fashionably designed.

The outside surface 33B of the rear wall 33 of the cellphone holder 30, exterior surface 41 A of the inner section or wall 41 and the exterior surface 42A of the outer section or wall 42 of the wallet 40 and exterior surface 51 A of the inner section or wall 51 of the purse 50 may have portions thereon having a Velcro® materiel, such as hook material 70A, adapted to engage a second portion of Velcro® loop material 70B on the other surface. This may be used to selectively removably mount the cellphone holder 30 and accessory holders 40, 50 to each other. Optionally, other type mounting means may be used for both removably mounting the cellphone holder 30 and accessory holders 40, 50 to each other, e.g., snaps, interlocking clips, mating notches, etc. For example, FIG. 3 shows the cellphone holder 30 and accessory holders 40, 50 removably mounted to each other through Velcro® brand hook and loop material 70A, 70B to each other. Optionally, the cellphone holder 30 and accessory holders 40, 50 may be permanently mounted to each other, e.g., glue, stitching, etc.

Different hand straps may be sold with the carrier 10 to provide different fashion statements and/or utilitarian functions. Likewise different holders 30, 40, 50 may be offered to provide different fashion statements and/or utilitarian functions. For example, if one is going to a formal social event one might design the carrier 10 with fabrics that match the users formal clothes or if one is sitting poolside or by the ocean, the carrier 10 may be designed to have water resistant or waterproof fabrics and holders 30, 40, 50.

This invention provides a handheld carrier 10 for a cellphone 20 and accessories suitable for use at social events and business meetings or for recreation and provides quick access to the user's cellphone 20 and the accessories held therein. The carrier 10 can be converted to several configurations depending on the accessories to be held and the user's preference. The look and function of the carrier 10 may be changed by interchanging the hand strap and/or accessory holders.

The invention has been described with reference to various specific and illustrative aspects of the present invention and techniques. However, it should be understood that many variations and modifications may be made while remaining within the spirit and scope of the invention. Many alternatives, modifications and variations will be apparent to those skilled in the art in light of the foregoing description. Accordingly, this invention is intended to embrace all such alternatives, modifications, and variations that fall within the spirit and scope of the appended claims.

What is claimed is:

1. A cellphone and accessory carrier to be held in a hand of a user, comprising:

a. a cellphone holder for holding a cellphone, the cellphone having a rear face and a front face, the cellphone holder including sidewalls that form an enclosure for the cellphone wherein the front face of the cellphone is exposed for use by the user and the rear face is covered by a rear wall having an inside surface overlaying the rear face of the cellphone and an outside surface;

b. a first and second accessory holder, each having an inner wall and outer wall forming an interior enclosure for holding accessories, each wall having an exterior surface, wherein the exterior surface of the inner wall of the first accessory holder is mounted to the outside surface of the rear wall of the cellphone holder and the exterior surface of the inner wall of the second accessory holder is mounted to the exterior surface of outer wall of the first accessory holder; and c. a hand strap having a first end and a second end, wherein the first end is mounted to a side of one of the cellphone holder or accessory holders and the second end is mounted to an opposed side of the same cellphone holder or accessory holder.

2. The cellphone and accessory carrier of claim 1, wherein the exterior surface of the inner wall of the second accessory holder is removably mounted to the exterior surface of the outer wall of the first accessory holder.

3. The cellphone and accessory carrier of claim 1, wherein the exterior surface of the inner wall of the first accessory holder is removably mounted to the outside surface of the rear wall and the exterior surface of the second accessory holder is removably mounted to the exterior surface of the outer wall of the first accessory holder.

4. The cellphone and accessory carrier of claim 1, wherein the first end of the hand strap is removably mounted to a side of one of the cellphone holder or accessory holders and the second end is removably mounted to an opposed side of the same cellphone holder or accessory holder.

5. The cellphone and accessory carrier of claim 1, wherein the first end of the hand strap is removably mounted to a side of the second accessory holder and the second end is mounted to an opposed side of the second accessory holder.

6. A cellphone and accessory carrier to be held in a hand of a user, comprising:

a. a cellphone holder for holding a cellphone, the cellphone having a rear face and a front face, the cellphone holder including sidewalls that form an enclosure for the cellphone wherein the front face of the cellphone is exposed for use by the user and the rear face is covered by a rear wall having an inside surface overlaying the rear face of the cellphone and an outside surface;

b. a first accessory holder having an inner wall and outer wall forming an interior enclosure for holding accessories, each wall having an exterior surface, wherein the exterior surface of the inner wall of the first accessory holder is mounted to the outside surface of the rear wall of the cellphone holder; and c. a hand strap having a first end and a second end, wherein the first end is mounted to a side of one of the cellphone holder or accessory holder and the second end is mounted to an opposed side of the same cellphone holder or accessory holder.

7. A cellphone and accessory carrier to be held in a hand of a user, comprising:

a. a cellphone holder for holding a cellphone, the cellphone having a rear face and a front face, the cellphone holder including sidewalls that form an enclosure for the cellphone wherein the front face of the cellphone is exposed for use by the user and the rear face is covered by a rear wall having an inside surface overlaying the rear face of the cellphone and an outside surface;

b. a wallet having an inner flap and an outer flap foldably connected to each other to form an interior enclosure for holding identification cards, each flap having an exterior surface;

c. a purse having a front section and a rear section, each section being fixed together at a common edge, the sections define an outside surface and an interior enclosure for carrying accessories, a purse closure for closing the interior enclosure to secure the accessories therein;

i. wherein the exterior surface of the inner flap of the wallet is mounted to the outside surface of the rear wall of the cellphone holder and the outside surface of the front section of purse is mounted to the exterior surface of the outer flap of the wallet; or ii. wherein the outside surface of the front section of purse is mounted the outside surface of the rear wall of the cellphone holder and the exterior surface of the inner flap of the wallet is mounted to the exterior surface of the rear section of the purse; and d. a hand strap having a first end and a second end, wherein the first end is mounted to a side of one of the cellphone holder, wallet or purse and the second end is mounted to an opposed side of the same cellphone holder, wallet or purse.

8. The cellphone and accessory carrier of claim 7, wherein the first end of the hand strap is removably mounted to the side of one of the cellphone holder, wallet or purse and the second end of the hand strap is removably mounted to the opposed side of the same cellphone holder, wallet or purse.

9. The cellphone and accessory carrier of claim 7, i. wherein the exterior surface of the inner flap of the wallet is removably mounted to the outside surface of the rear wall of the cellphone holder and the outside surface of the front section of purse is removably mounted to the exterior surface of the outer flap of the wallet; or ii. wherein the outside surface of the front section of purse is removably mounted the outside surface of the rear wall of the cellphone holder and the exterior surface of the inner flap of the wallet is removably mounted to the exterior surface of the rear section of the purse.

10. A cellphone and accessory carrier to be held in a hand of a user, comprising:

a. a cellphone holder for holding a cellphone, the cellphone having a rear face and a front face, the cellphone holder including sidewalls that form an enclosure for the cellphone wherein the front face of the cellphone is exposed for use by the user and the rear face is covered by a rear wall having an inside surface overlaying the rear face of the cellphone and an outside surface;

b. a wallet having an inner flap and an outer flap foldably connected to each other to form an interior enclosure for holding identification cards, each flap having an exterior surface, wherein the exterior surface of the inner flap is mounted to the outside surface of the rear wall of the cellphone holder;

c. a purse having a front section and a rear section, each section being fixed together at a common edge, the sections define an outside surface and an interior enclosure for carrying accessories, a purse closure for closing the interior enclosure to secure the accessories therein, wherein the outside surface of the front section is mounted to the exterior surface of the outer flap of the wallet;

d. a hand strap having a first end and a second end, wherein the first end is mounted to a side of one of the cellphone holder, wallet or purse and the second end is mounted to the opposed side of the same cellphone holder, wallet or purse.

11. The cellphone and accessory carrier of claim 10, wherein the first end of the hand strap is removably mounted to the side of one of the cellphone holder, wallet or purse and the second end of the hand strap is removably mounted to the opposed side of the same cellphone holder, wallet or purse.

12. The cellphone and accessory carrier of claim 10, wherein the exterior surface of the inner flap of the wallet is removably mounted to the outside surface of the rear wall of the cellphone holder and the outside surface of the front section of purse is removably mounted to the exterior surface of the outer flap of the wallet.

13. A cellphone and accessory carrier to be held in a hand of a user, comprising:

a. a cellphone holder for holding a cellphone, the cellphone having a rear face and a front face, the cellphone holder including sidewalls that form an enclosure for the cellphone wherein the front face of the cellphone is exposed for use by the user and the rear face is covered by a rear wall having an inside surface overlaying the rear face of the cellphone and an outside surface;

b. a wallet having an inner flap and an outer flap foldably connected to each other to form an interior enclosure for holding identification cards, each flap having an exterior surface;

c. a purse having a front section and a rear section, each section being fixed together at a common edge, the sections define an outside surface and an interior enclosure for carrying accessories, a purse closure for closing the interior enclosure to secure the accessories therein;

i. wherein the exterior surface of the inner flap of the wallet is mounted to the outside surface of the rear wall of the cellphone holder and the outside surface of the rear section of purse is mounted to the exterior surface of the outer flap of the wallet; or ii. wherein the outside surface of the front section of purse is mounted the outside surface of the rear wall of the cellphone holder and the exterior surface of the inner flap of the wallet is mounted to the exterior surface of the rear section of the purse.

14. A cellphone and accessory carrier to be held in a hand of a user, comprising:

a. a cellphone holder for holding a cellphone, the cellphone having a rear face and a front face, the cellphone holder including sidewalls that form an enclosure for the cellphone wherein the front face of the cellphone is exposed for use by the user and the rear face is covered by a rear wall having an inside surface overlaying the rear face of the cellphone and an outside surface;

b. a wallet having an inner flap and an outer flap foldably connected to each other to form an interior enclosure for holding identification cards, each flap having an exterior surface;

c. a purse having a front section and a rear section, each section being fixed together at a common edge, the sections define an outside surface and an interior enclosure for carrying accessories, a purse closure for closing the interior enclosure to secure the accessories therein;

i. wherein the exterior surface of the inner flap of the wallet is removably mounted to the outside surface of the rear wall of the cellphone holder and the outside surface of the front section of purse is removably mounted to the exterior surface of the outer flap of the wallet; or ii. wherein the outside surface of the front section of purse is removably mounted the outside surface of the rear wall of the cellphone holder and the exterior surface of the inner flap of the wallet is removably mounted to the exterior surface of the rear section of the purse.

15. A cellphone and accessory carrier to be held in the hand of a user, comprising:

a. a cellphone holder for holding a cellphone, the cellphone having a rear face and a front face, the cellphone holder including sidewalls that form an enclosure for the cellphone wherein the front face of the cellphone is exposed for use by the user and the rear face is covered by a rear wall having an inside surface overlaying the rear face of the cellphone and an outside surface;

b. a wallet having an inner flap and an outer flap foldably connected to each other to form an interior enclosure for holding identification cards, each flap having an exterior surface, wherein the exterior surface of the inner flap is removably mounted to the outside surface of the rear wall of the cellphone holder;

c. a purse having a front section and a rear section, each section being fixed together at a common edge, the sections define an outside surface and an interior enclosure for carrying accessories, a purse closure for closing the interior enclosure to secure the accessories therein, wherein the outside surface of the front section is removably mounted to the exterior surface of the outer flap of the wallet.

16. A cellphone and accessory carrier to be held in the hand of a user, comprising:

a. a cellphone holder for holding a cellphone, the cellphone having a rear face and a front face, the cellphone holder including sidewalls that form an enclosure for the cellphone wherein the front face of the cellphone is exposed for use by the user and the rear face is covered by a rear wall having an inside surface overlaying the rear face of the cellphone and an outside surface;

b. a wallet having an inner flap and an outer flap foldably connected to each other to form an interior enclosure for holding identification cards, each flap having an exterior surface, wherein the exterior surface of the inner flap is removably mounted to the outside surface of the rear wall of the cellphone holder;

c. a purse having a front section and a rear section, each section being fixed together at a common edge, the sections define an outside surface and an interior enclosure for carrying accessories, a purse closure for closing the interior enclosure to secure the accessories therein, wherein the outside surface of the front section is removably mounted to the exterior surface of the outer flap of the wallet;

d. a hand strap having a first end and a second end, wherein the first end is removably mounted to a side of the purse and the second end is mounted to an opposed side of the purse.

* * * * *